United States Patent [19]

Rose et al.

[11] 3,977,527

[45] Aug. 31, 1976

[54] FRAME FOR SUSPENSION OF DATA BINDERS

[75] Inventors: Allen J. Rose, Long Grove; Walter Feldmahr, Highland Park, both of Ill.

[73] Assignee: Acco International Inc., Chicago, Ill.

[22] Filed: Dec. 17, 1974

[21] Appl. No.: 533,678

[52] U.S. Cl. ..... 211/46; 211/113; 312/184

[51] Int. Cl.[2] ..... B42F 15/04; A47F 5/08

[58] Field of Search ..... 211/45, 46, 94.5, 94, 211/113, 122, 123, 124, 126, 162; 312/183, 184, 185, 187, 193, 321, 111, 107

[56] References Cited

UNITED STATES PATENTS

| | | | |
|---|---|---|---|
| 1,066,543 | 7/1913 | Stillwell | 312/184 |
| 1,571,623 | 2/1926 | Chartoff et al. | 211/71 |
| 1,604,995 | 11/1926 | Gruhler | 211/162 |
| 2,935,204 | 5/1960 | Jonas et al. | 211/46 |
| 3,249,111 | 5/1966 | Vincens | 211/46 X |
| 3,622,012 | 11/1971 | Lundgren | 211/126 |
| 3,684,340 | 8/1972 | Kirkorian | 312/183 |
| 3,790,242 | 2/1974 | Sullivan | 312/184 |
| 3,850,488 | 11/1974 | Elias et al. | 211/45 X |

FOREIGN PATENTS OR APPLICATIONS

| | | | |
|---|---|---|---|
| 1,272,708 | 10/1960 | France | 211/123 |
| 1,090,635 | 10/1960 | Germany | 312/184 |
| 6,411,528 | 4/1965 | Netherlands | 312/184 |
| 894,884 | 4/1962 | United Kingdom | 312/184 |

*Primary Examiner*—Roy D. Frazier
*Assistant Examiner*—Terrell P. Lewis
*Attorney, Agent, or Firm*—Elmer L. Zwickel

[57] ABSTRACT

A frame or rack including novel means for suspending therein data binders or the like in a multitude of positions and the lateral guide channels or tracks and cooperating hanger handles or bars used for lateral suspension.

3 Claims, 10 Drawing Figures

Fig. 6.
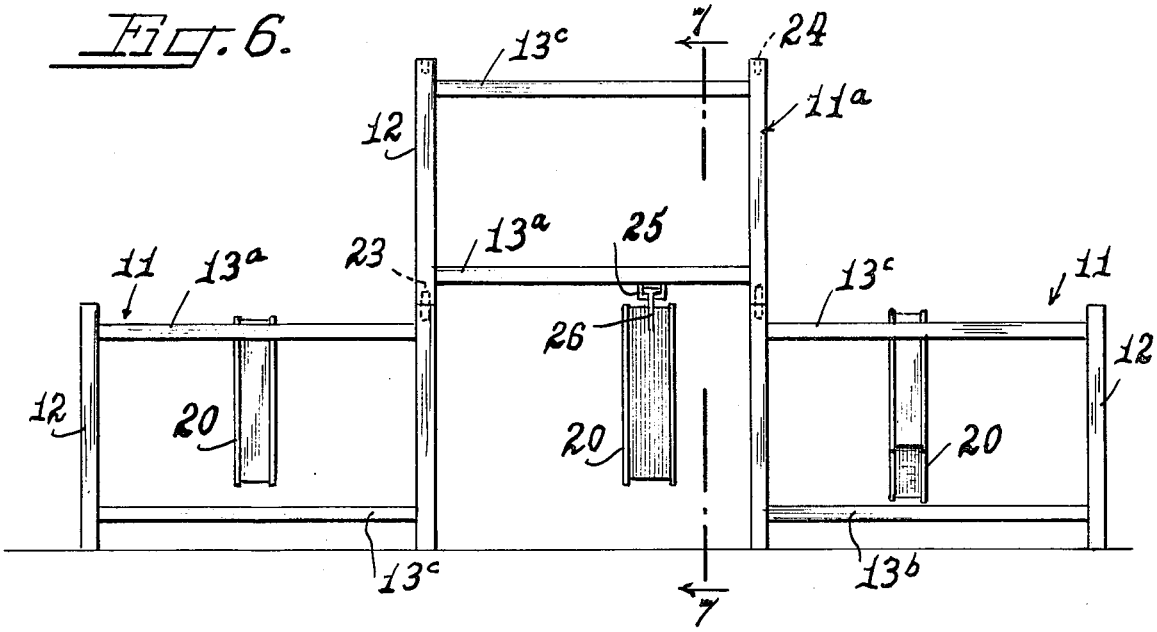
Fig. 7.
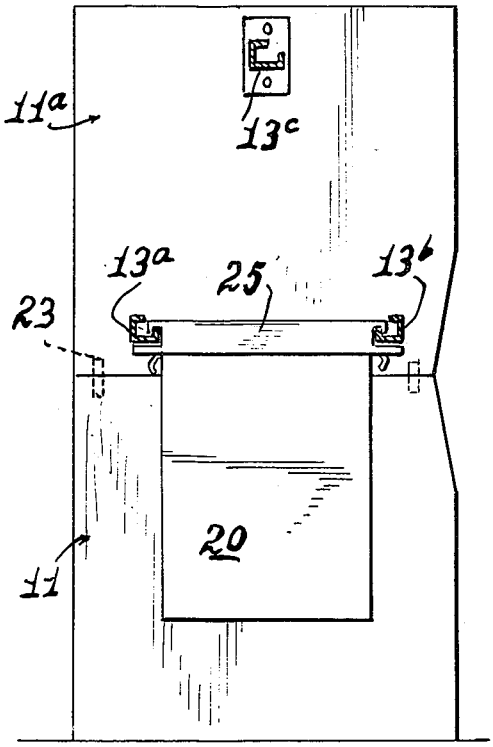
Fig. 8.
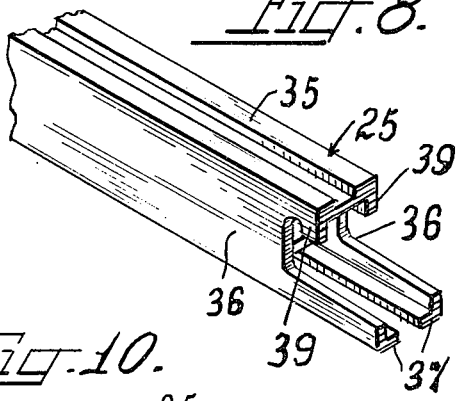
Fig. 10.
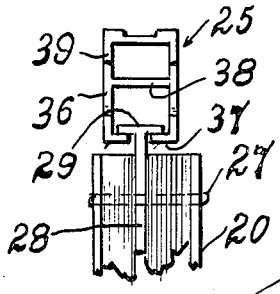
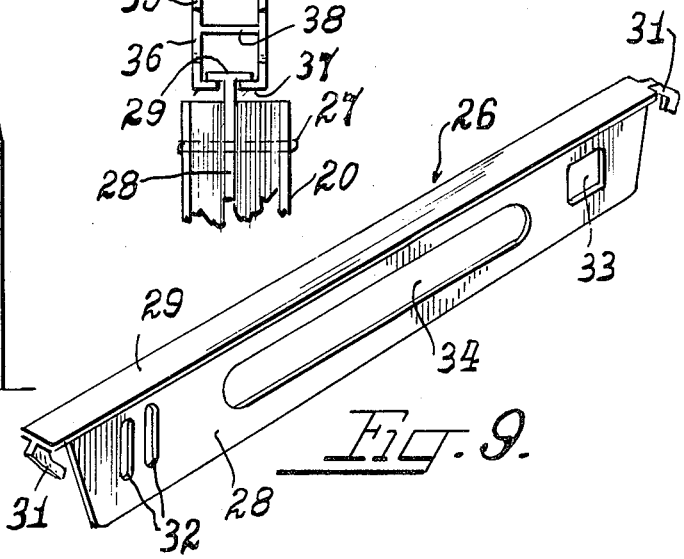
Fig. 9.

FRAME FOR SUSPENSION OF DATA BINDERS

The invention relates to improvements in racks and particularly to a rack frame embodying means for suspending therein one or more data binders having suspension means thereon, either in a horizontal position, an angular position or in position for lateral filing.

More particularly, the rack frame which is substantially rectangular in shape includes, on one side, a pair of spaced parallel hanger rails from which a data binder may be suspended by means of hooks at its ends in a horizontal position. The opposite side of the rack frame includes but one such rail which, when the rack frame is turned over i.e. inverted to locate said one rail at the uppermost side thereof, is used to suspend one end of the data binder by two of its hooks at said one end, for angular filing. The rack frame also includes removable lateral guides supported on the pair of hanger rails by means of hooks on its ends. The guides are in the form of inverted channels having flanges or rails to slidably receive therealong endwise, a hanger handle or bar connected to the data binder so as to afford lateral filing.

Another feature of the rack assembly is that the hanger rails can be reversed as to their relative position in the rack frame to adapt the assembly to receive data binders suspended from its bottom side when such rack frame is located in an elevated position. Further, a plurality of rack frames can be associated with each other, as by vertical stacking or side by side positioning to provide a plurality of like filing areas in which the same or all three modes of filing can be effected.

It is therefore an object of the invention to provide a rack frame of the character referred to.

Another object is to provide rack frames of the character referred to which may be arranged side by side or stacked.

Another object is to provide a rack frame of the character referred to which has a plurality of rails thereon capable of selective use for suspending data binders therefrom.

Another object is to provide novel hanger handles or bars on a data binder adapted for drop-in vertical filing or for lateral filing.

Another object is to provide a rack assembly of a type capable of receiving for filing therein a plurality of data binders which are either horizontally suspended, angularly suspended or suspended for lateral withdrawal.

Another object is to provide a rack assembly of the character referred to which is not difficult or expensive to manufacture but which is very efficient in use.

Other objects and advantages of the invention will become apparent with reference to the following description and accompanying drawings.

IN THE DRAWING;

FIG. 6 is a front elevational view of a plurality of stacked rack frames.

FIG. 7 is a sectional view taken substantially on line 7—7 of FIG. 6, showing a data binder suspended for lateral filing.

FIG. 8 is a fragmentary perspective view of the lateral guide shown in FIG. 7.

FIG. 9 is a perspective view of a hanger bar which is useful as a handle and to suspend a data binder for vertical, angular, or lateral filing.

FIG. 10 is an end view of a data binder equipped with the hanger handle or bar and suspended from the lateral guide.

Figure 1:
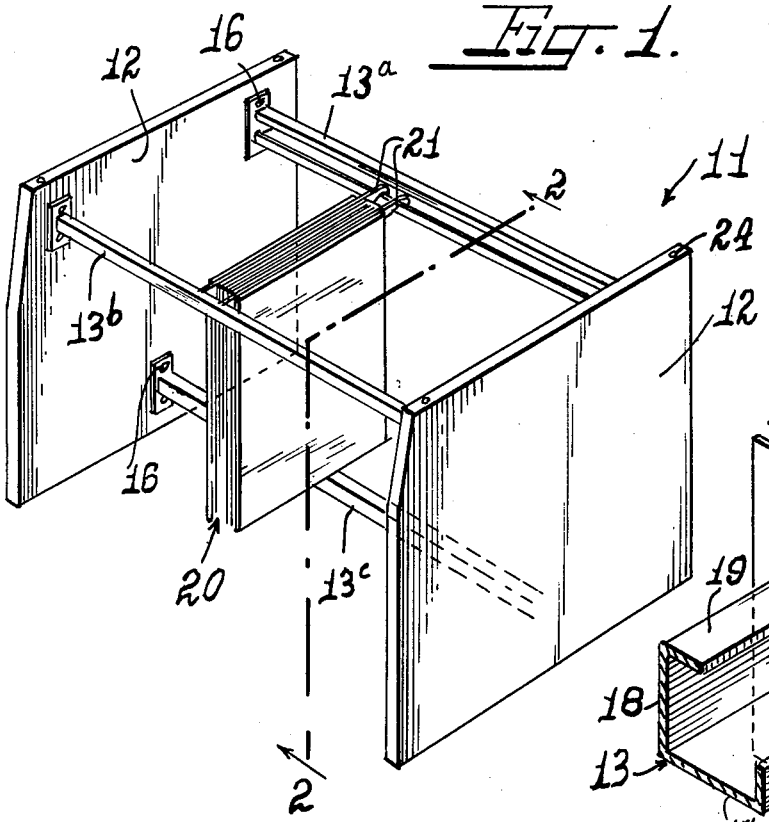
FIG. 1 is a perspective view of the rack frame showing a data binder suspended therein at both of its ends.

Referring to the exemplary disclosure of the invention in the accompanying drawing, the rack frame 11, best shown in FIG. 1, is substantially rectangular and it includes a pair of spaced apart upstanding end walls 12 having extending between them three parallel hanger rails 13. Two of the hanger rails, **13*a* and 13*b* are spaced apart laterally and are both secured to the end walls 12 closely adjacent to one edge of said end walls, in this instance the top edge. The third hanger rail 13*c* is centrally located between the front and back sides of the rack frame and is secured to the end walls 12** closely adjacent to an opposite edge of said walls.

Figure 4:
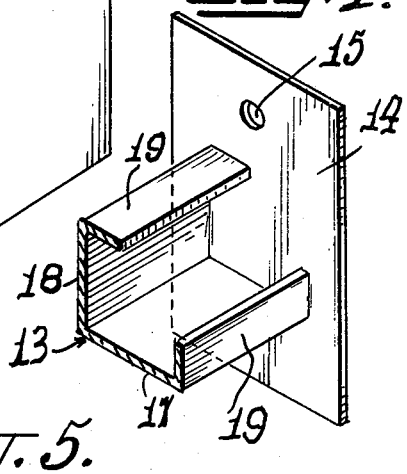
FIG. 4 is a fragmentary perspective view of a hanger rail.

As best shown in FIG. 4, the hanger rails **13*a*, 13*b* and 13*c* are identical and each includes on each of its ends a mounting plate 14 which may be welded or otherwide secured to said rail. This plate is symmetric and it preferably has two holes 15 to receive bolts 16 for securing the hanger bars to the end walls 12. It should be noted at this time, that the hanger rails are formed of sheet material longitudinally folded to provide a wall 17 having a side wall 18 extending normal thereto. These walls are of the same width and each is provided on its free edge with a narrow flange 19 that define tracks from which data binders 20 may be suspended. As shown, there are two laterally spaced parallel hanger rails 13*a* and 13*b* which lie in a horizontal plane closely adjacent to the top edge of said end walls. They are mounted so that their open sides are disposed upwardly to locate one of their flanges or tracks 19 vertically for a purpose to be described presently. The third hanger rail 13*c*** is centrally located adjacent to the opposite (bottom) edge of the end walls with its open side facing said edge also for a purpose to be described presently.

Figure 2:
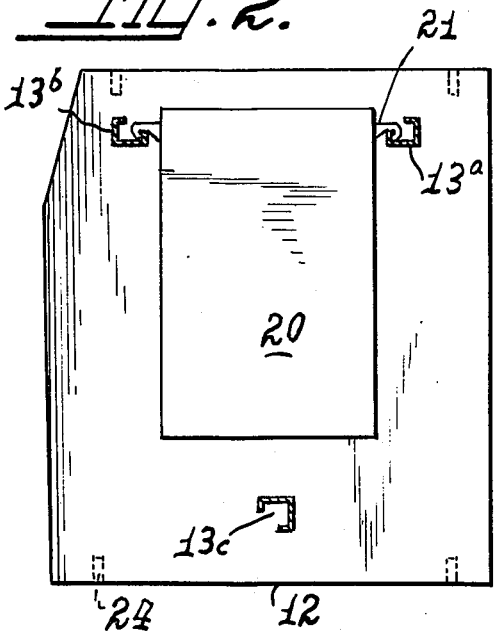
FIG. 2 is an enlarged detail sectional view taken substantially on line 2—2 of FIG. 1.

When the rack frame 11 is in the position shown in FIGS. 1 and 2, the two hanger rails **13*a* and 13*b* jointly afford means to suspend a data binder 20 which may be relatively thick and quite heavy, in a horizontal position. Such data binder includes hangers 20 one on each end, which include a reverse hook portion 22 of such size and configuration as to engage over the vertically disposed track 20 on each hanger rail 13*a* and 13*b*. The location of the engaged track 19** in the open side of the hanger rail permits the data binder to be dropped into place thereon and to be shifted longitudinally along the hanger rail into any desired position of adjustment.

Figure 5:
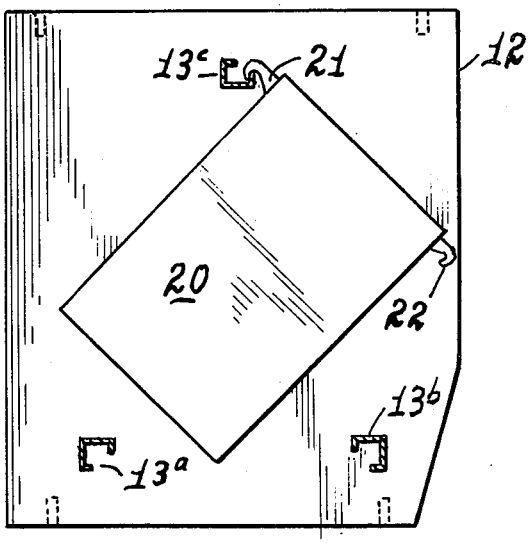
FIG. 5 is a view similar to FIG. 2, showing the rack frame inverted, i.e. turned from top to bottom and a data binder suspended angularly from one hanger rail.
Figure 3:
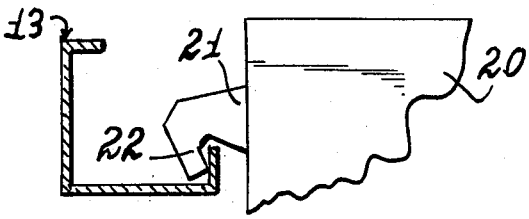
FIG. 3 is an enlarged detail sectional view of one of the hanger rails showing a data binder suspended vertically therefrom.

Should angular suspension of the file binder be desired, the rack frame 11 is turned over from top to bottom, as shown in FIG. 5, to locate the single hanger rail **13*c* at the top of the rack frame. The hook portions 22 on one end of the data binder hanger 21 can now be engaged with the flange or track 18 of hanger rail 13*c*,** as shown.

As noted hereinabove, two or more rack frames 11 may be stacked one upon the other or arranged side by side. When stacked, a dowel pin 23 is inserted into registering holes 24 in the abutted edges of the rack frames to prevent displacement.

Stacking may constitute vertical alignment of several rack frames or if desired, several rack frames may be stacked as indicated in FIGS. 6 and 7 for the purpose of providing additional filing space beneath the intermediate rack frame 11*a*. In the illustration, the intermediate rack frame 11*a* has its two hanger rails 13*a* and 13*b* reversed as compared with the showing in FIG. 2. More specifically, the hanger rails 13*a* and 13*b* are reversed top for bottom to locate the open sides thereof upwardly thereby positioning one of its flanges or tracks 19 in a vertical upstanding position. These two rails can now be used for lateral filing. Of course, the single hanger rail 13*c* of this stacked rack can be used for angular suspension of data binders as previously described.

Also, for purposes of illustration in FIG. 6, one of the bottom rack frames 11 is shown supporting data binders angularly, while the other bottom rack frame 11 is shown supporting data binders vertically, as described hereinabove. These bottom rack frames may be so positioned as to accommodate either type of data binder suspension as well as the lateral suspension system now to be described in connection with the intermediate rack frame 11*a*.

For lateral filing, a lateral guide 25 (FIG. 8) and a hanger handle 26 (FIG. 9) are employed. To this end the hanger handle 26 is secured to the data binder substantially midway its thickness, as by the conventional flexible post fastener 27 (FIG. 10). The hanger handle 26 comprises a web 28 having a T-shaped head 29 coextensive with its length and formed on its ends with hanger hooks 31 which can be used for vertical or angular filing without reference to the lateral guide. The web 28 has openings 32, 33 to receive the flexible post fasteners therethrough. The opening 33 preferably is relatively larger than opening 32 to provide a finger engaging opening for withdrawal of the hanger handle from its mounting. The web also has a longitudinally elongated opening 34 useful as a hand hold for carrying the data binder to which it is attached.

The lateral guide 25, best shown in FIG. 8, consists of an elongated member that is substantially square in section and includes a top wall 35, side walls 36 and inturned opposed flanges 37 forming a longitudinally slatted bottom wall. These flanges define guide rails for supporting the hanger handle bar 26 which is telescoped endwise thereinto as shown in FIG. 10. It might be noted at this time that when the hanger handle 26 is so used for lateral filing, the hooks 31 on its ends are not utilized. A reinforcing wall 38 bridges the side walls spaced substantially midway between the top and bottom walls. Each end of the lateral guide 25 is formed with hook extensions 39 on its side walls adapted to be seated on the rails 13*a* and 13*b*.

In view of the foregoing it should be obvious that applicants have provided a filing system that embodies a multitude of different modes of suspension filing, such as drop-in vertical filing, angular filing and lateral filing and, that the rack frame is of sufficient versatility to adopt it to all types of filing without repositioning of many parts or time consuming costly modification.

Although we have described a preferred embodiment of the invention, in considerable detail, it will be understood that the description thereof is intended to be illustrative rather than restrictive, as details of the structure may be modified or changed without departing from the spirit or scope of the invention. Accordingly, we do not desire to be restricted to the exact structure described and shown.

We claim:

1. An invertible rack structure comprising upstanding, spaced-apart, substantially square end walls, a pair of laterally spaced-apart hanger rails extending between and secured at their ends to the facing sides of said end walls at locations thereof closely adjacent the relatively upper-outer corners of said end walls and in a horizontal plane which is parallel to the top and bottom edges of said end walls, a single hanger rail extending between and secured at its ends to said facing sides of the end walls at locations thereof closely adjacent the relatively bottom edge of said end walls and centrally with respect to the aforesaid pair of hanger rails, said hanger rails each having L-section and being provided with a flange on the free edge of each leg of the L which extends towards and is substantially parallel to the other leg, thereby defining open-sided tracks, the open sides of the tracks of the relatively upper pair of hanger rails facing one another and the open side of the track provided by the single, centrally disposed hanger rail facing the relatively bottom edges of said end walls, the construction and arrangement being such that at least one data binder provided with end hooks may be hung from said pair of laterally spaced-apart hanger rails and that, upon inversion of the rack structure, at least one data binder may be hung from one of its said hooks in angular position from said single, centrally disposed hanger rail.

2. An invertible rack structure comprising spaced-apart upstanding substantially square end walls, a pair of spaced hanger rails bringing the space between and secured at their ends to said end walls closely adjacent to and disposed in a plane which is parallel to one edge of said walls, a single hanger rail bridging the space between and secured at its ends to said end walls closely adjacent an opposed edge of said walls, said hanger rails being L-shaped in section and having a flange on the free edge of each wall of the L extending substantially parallel to the other wall thereof to define tracks facing the said respective edges of said walls, means for supporting said rack structure in an inverted, elevated position wherein the pair of parallel-plane hanger rails are disposed adjacent the bottom edges of said end walls, and a lateral guide in said rack structure having reversely turned hook means on each end of said lateral guide, which hook means are engaged over the tracks of said pair of hanger rails and being operative to suspend a data binder for lateral filing in the space below the elevated rack structure.

3. An inverted channel guide for a data binder suspension system comprising, a top wall, side walls depending from said top wall, guide rails one on the free edge of each side rail, a reinforcing wall substantially coextensive with and bridging the side walls between their top and bottom edges, a suspension hook integral with each end of each side wall, and an end extension on each side wall spaced below and projecting beyond the hooks.

* * * * *